United States Patent [19]

Tsubata et al.

[11] 4,054,024

[45] Oct. 18, 1977

[54] APPARATUS FOR STOPPING AND RESTARTING THE OPERATION OF AN OPEN-END SPINNING SYSTEM

[75] Inventors: Kazuo Tsubata, Kyoto; Hironori Hirai, Nagaokakyo, both of Japan

[73] Assignee: Hironori Hirai, Nagaokakyo, Japan

[21] Appl. No.: 536,368

[22] Filed: Dec. 26, 1974

[30] Foreign Application Priority Data

Sept. 30, 1974 Japan ..... 49-112951
Oct. 4, 1974 Japan ..... 49-115053

[51] Int. Cl.[2] ..... D01H 1/20

[52] U.S. Cl. ..... 57/78; 57/34 R; 57/58.95

[58] Field of Search ..... 57/34 R, 78, 58.89–58.95

[56] References Cited

U.S. PATENT DOCUMENTS

| | | | |
|---|---|---|---|
| 3,425,205 | 2/1969 | Landwehrkamp et al. | 57/58.89 |
| 3,455,095 | 7/1969 | Makeham et al. | 57/58.89 X |
| 3,492,804 | 2/1970 | Landwehrkamp et al. | 57/58.89 X |
| 3,541,774 | 11/1970 | Sterba et al. | 57/58.89 X |
| 3,650,104 | 3/1972 | Shepherd et al. | 57/58.95 X |
| 3,680,300 | 8/1972 | Landwehrkamp | 57/58.95 X |
| 3,732,681 | 5/1973 | Kutscher et al. | 57/58.89 X |
| 3,750,381 | 8/1973 | Greenwood et al. | 57/58.95 X |
| 3,760,576 | 9/1973 | Le Chatelier et al. | 57/58.89 X |

*Primary Examiner*—Richard C. Queisser
*Assistant Examiner*—Charles Gorenstein
*Attorney, Agent, or Firm*—Whittemore, Hulbert & Belknap

[57] ABSTRACT

The present invention relates to an open-end spinning system and more particularly to a method and an apparatus for stopping and starting the spinning operation of the open-end spinning system in such a way that the end portion of the spun yarn of the previous spinning may be used as it is as the piecing-up end yarn for the following spinning operation. The apparatus of the present invention, includes means for positively braking the combing roller for concurrently and suddenly stopping the rotation of the combing roller and the feed roller and means for taking the end portion of the spun yarn out of the spinning rotor, maintaining the taken out portion in a deflected state with the end of the yarn disposed within a spinning tube, and releasing the yarn at the restart of the spinning operation so that said end portion may be injected into the spinning rotor.

2 Claims, 7 Drawing Figures

APPARATUS FOR STOPPING AND RESTARTING THE OPERATION OF AN OPEN-END SPINNING SYSTEM

BACKGROUND OF THE INVENTION

In an open-end spinning machine, the feed roller is rotated at a slow speed during the spinning operation. Thus, at the time of stopping the spinning operation, the feed roller may be stopped speedily by switching off the drive source. However, the combing roller is rotated during the spinning at a speed higher than 8,000 r.p.m. and thus it keeps on rotating for some time after the driving source is switched off. After the rotation of the feed roller is terminated, a certain amount of sliver is left on the surface of the feed roller. Since the combing roller is rotated by inertia, the sliver is fed little by little into the spinning rotor, as it is subjected to the combing action. The fiber thus supplied into the rotor is spun by the inertia rotation of the rotor into a long tennuous yarn which is connected integrally to the end of the spun yarn, as shown in FIG. 1. When the terminal yarn portion of such shape is fed into the rotor as an end yarn at the next spinning operation, it may not be entangled with the sliver at all or at least the yarn terminal portion will not be united evenly with the sliver.

BRIEF SUMMARY OF THE INVENTION

The present invention resides essentially in a method and an apparatus according to which the terminal portion of the spun yarn of the preceding open-end spinning operation may be used as a piecing-up end yarn at the restart of the spinning. The present invention is applied most effectively to a spinning system including a number of single spinning units wherein the yarn piecing up and winding operation is effected in unison at the respective spinning units after transient interruption of the spinning operation for maintenance and so forth. The present invention may also be applied to a spinning system where the cessation of spinning, the subsequent yarn piecing up operation and the restart of winding are effected separately at the respective spinning units.

It is an object of the present invention to realize a terminal portion of the spun yarn of the preceding spinning in such a way that said terminal portion may be used conveniently as an end yarn to be successfully pieced up to the fresh sliver. For this purpose, a suitable twist must be inserted in the end yarn. According to the present invention, the terminal portion of the spun yarn is taken up from the rotor at variable yarn speed in proportion to the rotor speed to maintain the normal spinning condition. Since the rotor is disconnected from the drive source upon issuance of an instruction signal for stopping the spinning, the rotor is rotated for some time by inertia, so that the twist may be inserted as desired to said terminal portion. By taking up the terminal portion at a speed compatible with the prevailing spinning speed, said portion may be fashioned as a continuous and integral part of the spun yarn without any sudden changes in the status of the yarn, such as number of twists per unit length. Thus, the spun yarn and the fresh sliver are pieced up to each other uniformly upon restarting the spinning operation. In addition, the combing roller of each spinning unit may be stopped suddenly by positively braking the combing roller upon cessation of the spinning, so as to prevent the useless supply of the fiber to the rotor which may result in a long and tenuous yarn end portion. Thus the yarn end portion highly convenient for the piecing up operation may be obtained, as shown schematically in FIG. 2.

Another object of the present invention is to get the yarn end portion introduced in an optimum state into the rotor at the restart of the spinning operation. Thus, according to the present invention, the yarn end portion is kept in a deflected position as it is taken out of the rotor at the cessation of the spinning, and stopped so that the yarn end is disposed within a spinning tube provided in direct adjacency to the spinning rotor. At the restart of the winding operation, the yarn end portion is again straightened and inserted into the rotor as end yarn so as to be pieced up with the sliver. In order that the yarn end portion may not be thrown out of the spinning tube due to twist shrinkage, a yarn grip piece is provided to the upper end of a braking lever designed to apply a braking force to the combing roller.

At this time, if the end yarn should be supplied into the rotor at an excess speed, it may be subjected to a slight oscillation or travel in a zigzag line and thus the yarn may be pieced to the sliver in a disorderly state. According to the present invention, it is possible to control the supply speed of the yarn end portion to be lower than the speed of suction air current provided in the spinning tube so that the yarn end portion may be supplied in a taut state into the rotating rotor.

In addition, the present invention provides an apparatus wherein a single drive shaft is connected to a common driving shaft for the wind-up packages of the respective spinning units through a first clutch and also to a drive device for a yarn deflective rod through a second or a reversible clutch, whereby said rod may be reciprocated or stopped so as to deflect the yarn end portion at the cessation of spinning or straighten it up at the restart of the spinning. Such apparatus is especially convenient for a spinning system wherein a number of the spinning units of the system are started or stopped simultaneously.

DETAILED DESCRIPTION OF THE INVENTION

Reference in now had to the accompanying drawings for illustration of a preferred embodiment of the present invention.

Figure 1:
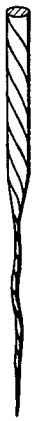
FIG. 1 (PRIOR ART)
FIG. 1 is an explanatory view showing the shape of the terminal portion of the spun yarn obtained in the conventional method.
Figure 2:
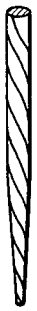
FIG. 2 is a similar view to FIG. 1 showing the shape of the terminal portion of the spun yarn obtained in the inventive method.
Figure 3:
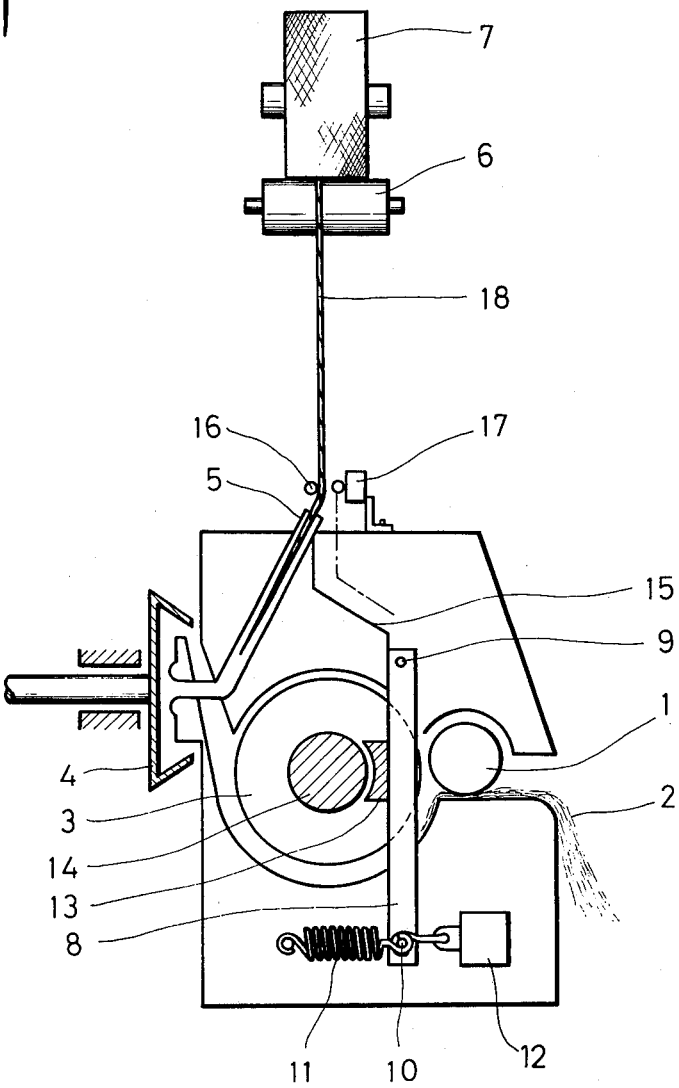
FIG. 3 is a partial diagrammatic view showing a spinning unit in accordance with the present apparatus.

Referring to FIG. 3, the fiber supplied by a feed roll 1 is opened by a combing roller 3 and supplied into a spinning rotor 4 where the fiber is spun into a yarn with rotation of the rotor 4. The spun yarn is fed through a spinning tube 5 and wound up on a package 7 as it is imparted a traverse motion at a drum 6. A braking lever for braking the combing roller 3 is shown at 8 and is journaled at one end by a pivot pin 9 and provided with a boss 10 at the other end for engagement with a spring 11 and an actuating arm provided to a solenoid 12. During the spinning operation, the solenoid 12 is usually energized and thus the braking force is not applied to the combing roller. Upon cessation of the spinning, the solenoid 12 is de-energized. Thus, a brake shoe 13 provided to the braking lever 8 is pressed onto a shaft 14 of the combing roller 3, under the force of the compression spring 11, so as to brake the combing roller. The numeral 15 denotes a grip lever secured to the braking lever 8 and provided with a yarn grip piece 16 which is located at the exit of the spinning tube 5. As the braking lever 8 is pivoted about pivot pin 9 for braking the combing roller, said grip lever 15 is also pivoted concurrently with the braking lever 8 so that the spun yarn 18 is gripped between the yarn grip piece 16 and a fixed stopper 17. The grip lever 15 is preferably a leaf spring in order to resiliently grip the yarn 18 by the yarn piece 16 and the fixed stopper 17.

Figure 4:
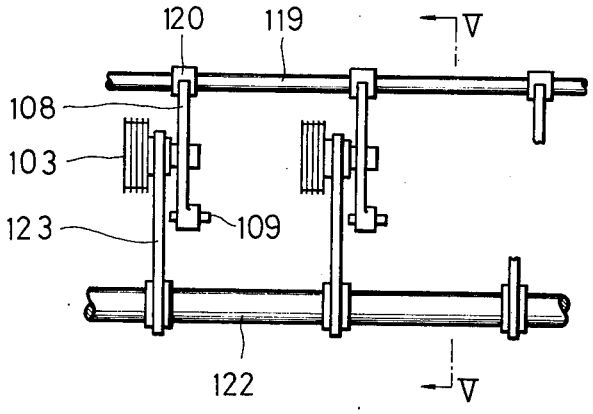
FIG. 4 is a partial plan view showing the braking device for the combing roller in accordance with the present invention.
Figure 5:
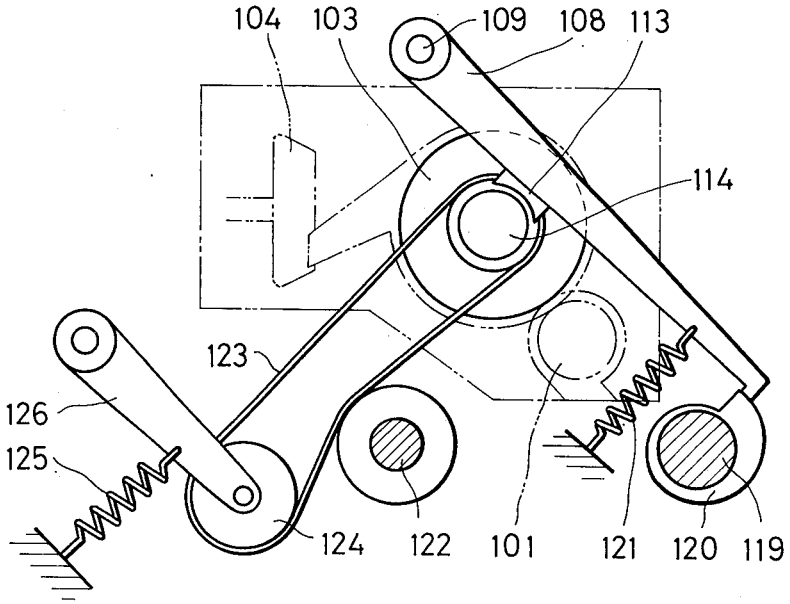
FIG. 5 is a sectional view taken along line V — V of FIG. 4.

Although a single spinning unit is shown in FIG. 3, usually a large number of the spinning units as shown in FIG. 3 are arranged in parallel in a single spinning system. In a modified embodiment shown in FIGS. 4 and 5, the solenoids 12 of the spinning units can be actuated simultaneously for simultaneously braking the combing rollers of all of the spinning units. Referring to FIGS. 4 and 5, a braking lever 108 is mounted pivotally by a pivot pin 109 as in the preceding embodiment of FIG. 3. Said lever 108 is associated at the other end with a spring 121 and thereby urged into pressure contact with a cam 120 secured to a common cam shaft 119 for a number of the spinning units. Said cam shaft extends in the array direction of the spinning units. Thus, with rotation of the cam shaft 119, each braking lever 108 is pivoted gradually so that the brake shoe 113 associated therewith is brought into pressure contact with a shaft 114 of a combing roller 103 of each spinning unit for simultaneously braking all the combing rolls of the spinning system. The rotor or spinning chamber is shown schematically at 104. The cam 120 has such a profile that the cam surface thereof is elevated gradually to the point of maximum height and then lowered suddenly to the point of minimum height as measured from its inner surface. Due to such cam profile, the braking lever 108 is returned from the braking position to the non-braking position as the contact point of the end of the brake lever 108 with the cam surface is shifted from said point of the minimum height to said point of the maximum height. The shafts 114 of the respective spinning units are driven by a common driving shaft 122 by way of a transmission belt 123. A tension pulley 124 for the belt 123 is journaled at the end part of a lever 126 which is associated with a spring 125.

Figure 6:
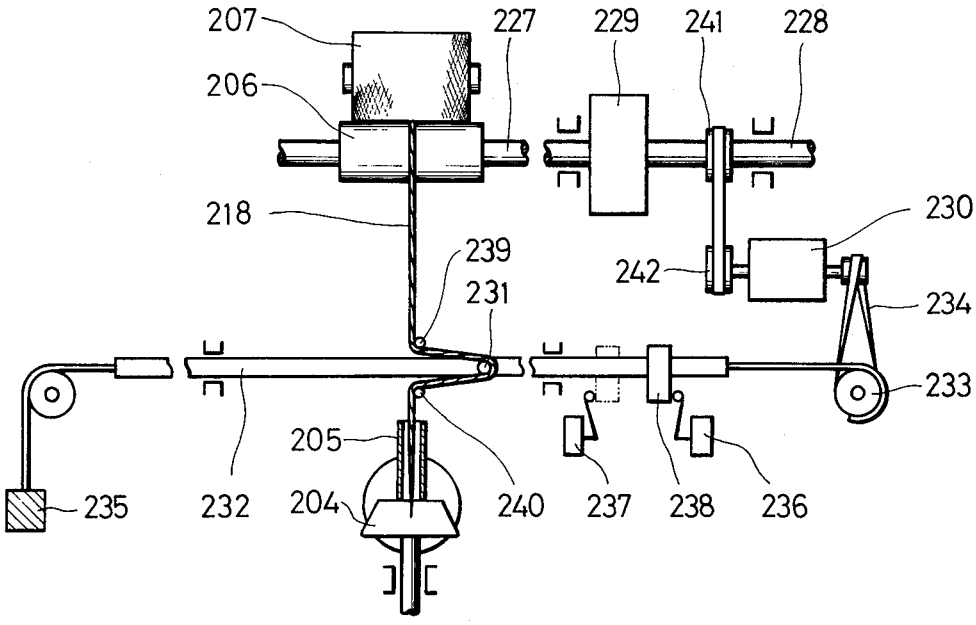
FIG. 6 is a front view showing the yarn deflective device in accordance with the present invention.

The yarn deflecting mechanism is shown in detail in FIG. 6. A first clutch 229 and a second or reversible clutch 230 are mounted to a driving shaft 228. A drum shaft 227 carrying a number of drums 206 of the respective spinning units is connected to the first clutch 229, while the second clutch 230 is associated by way of a transmission belt 234 with a pulley 233 associated in turn with the end of a deviating rod 232 which is fitted securely with a number of deviating guides 231 for the respective spinning units.

The numeral 235 designates a weight mass connected to the other end of the yarn deflective rod 232, and the numerals 236, 237 designate a pair of microswitches associated with the second clutch 230. These microswitches, when pressed by a dog 238 secured to the rod 238, will operate so as to disconnect said second clutch to stop the movement of the rod 238 at the two predetermined limit positions. The numeral 207 designates a yarn winding package, the numerals 239, 240 designate yarn guides and the numeral 205 designates a spinning tube. The driving shaft 228 is connected, by way of a gearing, not shown, to a drive device for a transmission belt, also not shown, for driving the rotor 204 into rotation.

Figure 7:
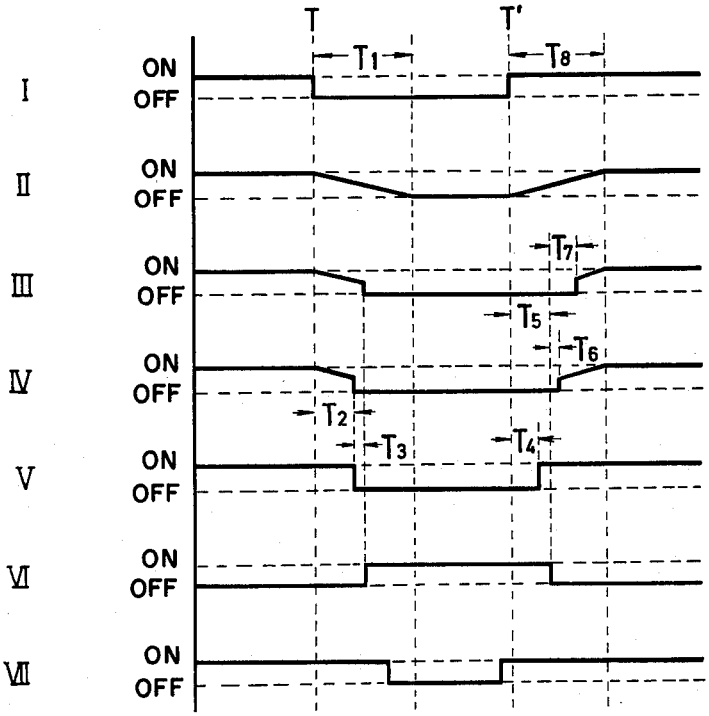
FIG. 7 is a diagram for explanation of the operation of the present apparatus.

The operation of the present apparatus will be described below by referring mainly to FIG. 7. In the diagram of FIG. 7, I is an electrical source which is switched on or off in accordance with the desired operation of the spinning system and II to VII show the stop and restart of each means of the invention respectively. That is, II is an operation of the rotor; III is that of the drum or package; IV is that of the feed roller; V is that of the combing roller; VI is that of the yarn deflective guide; and VII is the suction means.

When the spinning units are disconnected from an electrical source at a time T the rotor 104, the drum 206 and the feed roll 101 are decelerated gradually and brought to a halt after lapse of a time interval $T_1$. During the inertia rotation and after lapse of a further time interval $T_2$, the rotation of the feed roll 101 and that of the driving shaft 122 are stopped, at the same time that rotation of the combing rollers of the spinning units is terminated suddenly and unanimously due to actuation of the braking lever 108. The supply of the fiber into the spinning rotor is now terminated. After lapse of time interval $T_3$, the first clutch 229 is disconnected, and the drums 206 are brought to a stop suddenly by the operation of a braking device, not shown, provided in the clutch 229. Rotation of the package 207 connected to each drum 206 is also terminated. At this time, the second or reversible clutch 230 is connected to the forward side by an output signal from an AND gate (not shown) to the input terminals of which are supplied an input signal from the microswitch 237 which is turned on by engagement with the dog 238 and an input instruction signal for stopping the spinning operation. The yarn deflective rod 232 is now moved towards the right in FIG. 6, due to the forward revolution of the output shaft of the second clutch 230. The spun yarn is deflected from its normal path by engagement with the yarn deflective guide 231. As the rod 232 is moved further and the microswitch 236 is acted upon by the dog 238, the translatory movement of the deflective rod 232 is terminated upon disengagement of the second clutch.

If the yarn deflective guide 231 is moved at this time so that the spun yarn is withdrawn from the rotor 204 at a variable yarn speed in proportion to the decreasing rotor speed, that is, maintaining the same ratio of the normal take out speed to the number of the rotation of the rotor, the yarn end may have a number of twists per unit yarn length equal to that obtained during the normal spinning. This variable take-out speed can be set by proper selection of the speed reducing ratio of the pulleys 241, 242 designed to transmit the rotation of the driving shaft 228 to the output side of the second clutch 230. After this operation, the air suction unit associated with the spinning rotor is switched off.

When restaring the spinning operation, the electrical source is switched on after lapse of time interval T' from the starting time of the suction unit. Thus the spinning rotor 104 is started and driven at a gradually increasing speed. After lapse of time interval $T_4$, the braking lever 108 is disengaged from the combing roller 103, whilst the driving shaft 122 is driven into rotation, so that the combing roller 103 starts again to rotate. After time interval $T_5$ when the rotor 104 has attained a speed sufficient for piecing up the yarn to the sliver, the instruction signal for restarting the spinning operation is applied to an input terminal of the AND gate (not shown) to the other input terminal of which is also supplied a signal from the microswitch 236 which is turned on by engagement with the dog 238 during the cessation of spinning. The output signal from the AND gate is supplied to the reversible clutch 230 as that the latter is connected for reverse rotation of the output shaft. Thus the yarn deflective rod 232 is moved towards left in FIG. 6. The spun yarn, thus far gripped by the yarn deflective guide 231, is now released and inserted into the inside of the spinning rotor 204 as an end yarn. At this time, the yarn deflective rod 232 is moved at a speed such that the end yarn may be inserted into the rotor 204 at a slower rate than that of the suction air current pervailing in the suction tube 205.

Thus the end yarn may be inserted in a straight position into the rotor. To this end, the suction force of the air suction unit may be adjusted relatively to the rightward movement of the rod 232. As the microswitch 237 is pressed by the dog 238, the second clutch 230 is switched to its neutral position so that rightward movement of the deflective rod 232 is now terminated. After lapse of a time interval $T_6$ from the time of insertion of the end yarn, the feed roller 101 is started again to start the supply of the fiber. After lapse of a further interval time $T_7$, the clutch 229 is engaged again to start the rotation of the drum 206 and the winding of the spun yarn. The spinning operation will be continued at a working speed after lapse of a time interval $T_8$ from the time of starting of the spinning rotor.

The above time intervals for the start and termination of the various elements may be set by using the conventional timing devices.

What is claimed is:

1. An apparatus for stopping and restarting the operation of a spinning system consisting of a large number of spinning units, each including a spinning tube, driving roller, a wind-up package and a combing roller, in such a way that the terminal portion of spun yarn resulting from preceding spinning at each said spinning unit may be used as an end yarn capable of being pieced up with fresh sliver supplied into the spinning rotor, said apparatus comprising a common mounting shaft to which the driving rollers for the wind-up packages of the respective spinning units are mounted securely, a single yarn deflective rod extending on top of the respective spinning units, said rod carrying yarn deflective guides each being designed to maintain the terminal portion of the yarn of each spinning unit in the deflected position, a first clutch, a second, reversible clutch, a drive device for said deflective rod, a driving shaft connected to said common mounting shaft through said first clutch and to said drive device for said deflective rod through said second, reversible clutch, braking means associated with each of the combing rollers of the respective spinning units for simultaneous, sudden and positive braking of the combing rollers to prevent useless supply of slivers to the rotor which may result in a long and slender yarn end portion and simultaneous release of braking force to said combing rollers, and a yarn grip piece, for gripping the terminal portion of the spun yarn at the exit of the spinning tube, mounted on the braking means adapted for applying the braking force to the combing roller.

2. An apparatus defined in claim 1, and further including a common cam shaft extending in the array direction of the spinning units and cams securely mounted to the shaft, wherein the braking means for braking the combing rollers of the respective spinning units are adapted to cooperate with the cams whereby said braking means of the respective spinning units are actuated simultaneously by rotation of said cam shaft.

* * * * *